US008651173B2

(12) United States Patent
Joseph et al.

(10) Patent No.: US 8,651,173 B2
(45) Date of Patent: Feb. 18, 2014

(54) MODULAR CONTROL SYSTEM FOR DOWNHOLE TOOL

(75) Inventors: Paul Joseph, Missouri City, TX (US); Luis E. Mendez, Houston, TX (US); Ajeet G. Kamath, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 256 days.

(21) Appl. No.: 13/156,764

(22) Filed: Jun. 9, 2011

(65) Prior Publication Data

US 2012/0312523 A1 Dec. 13, 2012

(51) Int. Cl.
*E21B 23/00* (2006.01)

(52) U.S. Cl.
USPC ..... 166/65.1; 166/378

(58) Field of Classification Search
USPC ..... 166/65.1, 378, 241.6
See application file for complete search history.

(56) References Cited

U.S. PATENT DOCUMENTS 6,067,922 A * 5/2000 Denison et al. ..... 114/243
6,138,754 A 10/2000 Veneruso et al.
7,237,616 B2 * 7/2007 Patel ..... 166/381
8,056,628 B2 * 11/2011 Whitsitt et al. ..... 166/278
2002/0146287 A1 * 10/2002 Allen et al. ..... 405/211
2003/0070806 A1 4/2003 Connell et al.
2004/0026086 A1 2/2004 Patel
2008/0023192 A1 * 1/2008 Hayes et al. ..... 166/77.1
2010/0284750 A1 11/2010 Begley

FOREIGN PATENT DOCUMENTS

WO 2009026217 A2 2/2009

OTHER PUBLICATIONS

International Search Report and Written Opinion; date of mailing Nov. 23, 2012; International Application No. PCT/US2012/034976; Korean Intellectual Property Office; International Search Report 5 pages; Written Opinion 5 pages.
Halliburton "DynaLink Telemetry System" Reliable Wireless Downhole Telemetry Technology, Testing and Subsea, www.halliburton.com, H04930, Jan. 2010, pp. 1-2.

* cited by examiner

*Primary Examiner* — Daniel P Stephenson
(74) *Attorney, Agent, or Firm* — Cantor Colburn LLP

(57) ABSTRACT

A modular control system includes a control module removably attachable to an exterior of a downhole tool. A controlled device, the controlled device providing a function for the downhole tool. The controlled device controlled by the control module.

20 Claims, 6 Drawing Sheets

MODULAR CONTROL SYSTEM FOR DOWNHOLE TOOL

BACKGROUND

Completion systems in most wells employ multiple tubings to make up a tubing string in order to bring production fluid from downhole to surface or surface fluids to a downhole location. For desired fluid movement to enter or leave the tubing from or to the annulus between an exterior of the tubing and the formation wall, at least one of the tubing includes a valve that may be actuated hydraulically, pneumatically, electrically, mechanically, or a combination thereof, either by surface intervention or by intelligent systems in a downhole environment or uphole. When a downhole intelligent system is used to selectively control the valve, the tubing is specially provided with access channels or other modifications to incorporate the intelligent control device and its necessary connections resulting in increased cost of the string.

BRIEF DESCRIPTION

A modular control system includes a control module removably attachable to an exterior of a downhole tool; and a controlled device, the controlled device providing a function for the downhole tool, the controlled device controlled by the control module.

A modular control system includes a control module removably attachable to an exterior of a downhole tool; and a clamshell packoff including a tubular member split along its wall substantially from one longitudinal end to another longitudinal end and having a longitudinally extending aperture sized to accommodate the control module and downhole tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
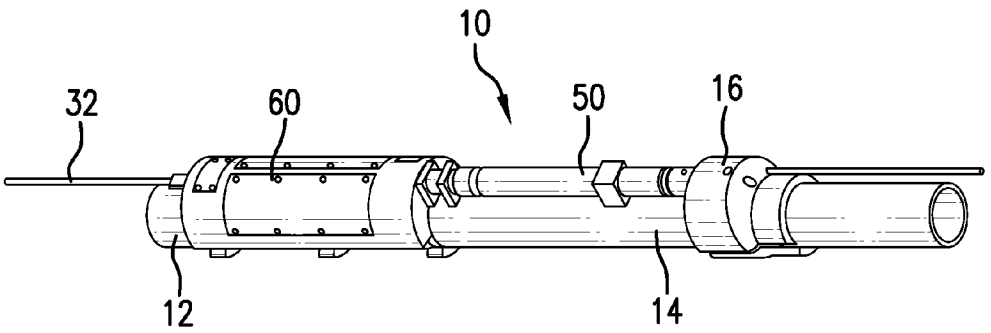
FIG. 1 depicts a perspective view of an exemplary embodiment of an intelligent flow control assembly attached to a tubing string.
Figure 2:
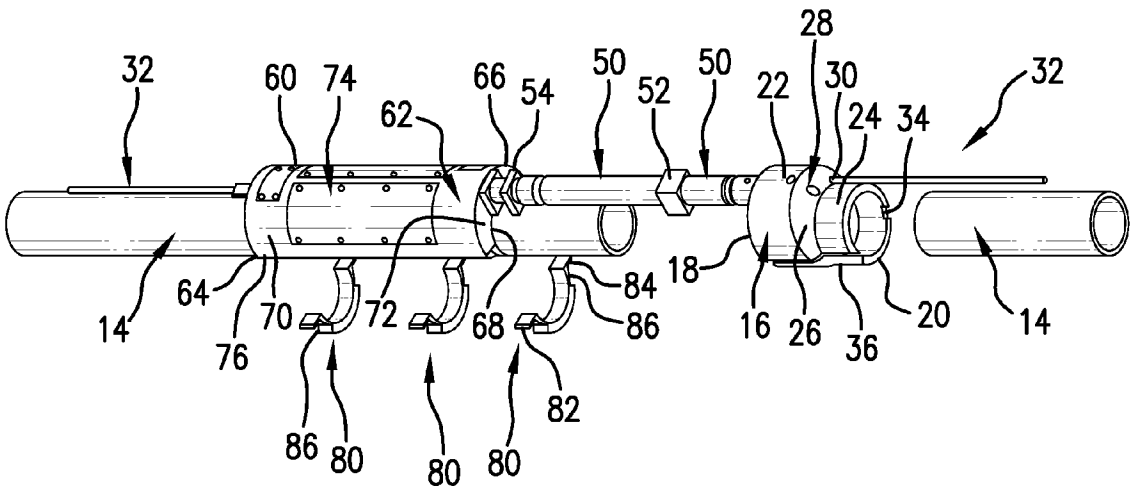
FIG. 2 depicts a partially exploded perspective view of the intelligent flow control assembly of FIG. 1.

With reference to FIGS. 1 and 2, in one exemplary embodiment, a modular control system includes a low cost intelligent flow control device 10 which is provided to a downhole tool, such as a production tubing string 12, hereinafter "string", to actuate a valve at a tubing 14 to bring production fluid from downhole to surface, for example. The string 12 may be formed from multiple tubings 14 and passed within a borehole. The tubing 14 may include a connection on each respective end to connect with adjacent tubing 14, such as by threads, at a tubing coupling 16, so that the tubing 14 may be interconnected. In an exemplary embodiment of this invention, the tubing 14 may be any known commercially available tubing 14, and need not be specially designed for incorporating the low cost intelligent flow control device 10. As is well known in the industry, the borehole has a formation wall and an annulus is formed between an outer surface of the string 12 and the formation wall, or between an outer surface of the string 12 and an inner surface of a casing (not shown) inserted into the borehole.

Between a pair of adjacent tubings 14, a tubing coupling 16 may be arranged. The tubings 14 are connected to both sides of the tubing coupling 16 via threads. This connection at the tubing coupling 16 is called a tubing joint. The tubing coupling 16 includes a first end 18 and a second end 20. The tubing coupling 16 includes an inner aperture that, when arranged with the tubings 14, may share the same longitudinal axis of the string 12. Adjacent the first end 18 of the tubing coupling 16, the tubing coupling 16 may include a first section 22 having a first diameter, and adjacent the second end 20 of the tubing coupling 16, the tubing coupling 16 may include a second section 24 having a second diameter smaller than the first diameter. Both sections 22, 24 may have a larger diameter than the tubings 14. Between the first and second ends 18, 20 of the tubing coupling 16, a transition section 26 may be formed that transitions the first section 22 to the second section 24. A fluid entry port 28 is formed through the tubing coupling 16, such as through the transition section 26, which provides for fluid entry into the string 12, although the flow between the interior of the string 12 and an exterior of the string 12 may be in either direction, such as into the interior of the string 12 for entry of production fluids or exiting to the exterior of the string 12 if the tubing string 12 is delivering a solvent or other fluids through the fluid entry port 28. Also, an aperture 30 may be provided through the tubing coupling 16 for a line 32 (such as a tubing encapsulated conductor ("TEC") or other control or monitoring line), such as through the transition section 26. The tubing coupling 16 may also include longitudinally extending channels 34, 36 sized to receive aperture blocks 38, as shown for example in FIG. 7. The aperture blocks 38 may include a plurality of apertures for providing access channels for conductors or any other lines that are needed to pass into the wellbore along the string 12. The aperture blocks 38 may extend the entire length of the string 12, or any necessary portion thereof.

The actuator and valve assembly 50 is provided adjacent the first end 18 of the tubing coupling 16 to control opening or closing of the fluid entry port 28 on the tubing coupling 16 between the annulus and the interior of the string 12. Portions of the actuator and valve assembly 50 may pass through an interior of the tubing coupling 16 to interact and control the fluid entry port 28. The actuator and valve assembly 50 is positionable at an exterior of a tubing 14, and may include a longitudinal axis that is parallel to but offset from the longitudinal axis of the tubing 14. The actuator and valve assembly 50 may be supported adjacent a tubing 14 by supports 52 and 54 which include an aperture for receiving the actuator and valve assembly 50 therein and a curved outer surface on a bottom portion thereof for interfacing with a curved outer surface of the tubing 14. The supports 52, 54 may also support the actuator and valve assembly 50 at a selected distance from the tubing 14, so that the actuator and valve assembly 50 can be properly aligned between the tubing coupling 16 and an electronics module 60, which will be further described below. The line 32 may extend through the aperture 30 of the tubing coupling 16 and to the actuator and valve assembly 50. One of ordinary skill in the art will appreciate that a valve assembly included in the actuator and valve assembly 50 allows or prevents fluid migration from or to a zone surrounding the tubing coupling 16 or area adjacent the string 12 where the valve assembly is located. The actuator and valve assembly 50 includes an actuator that may be connected to the valve assembly for actuation of the valve assembly. The valve assembly may be actuated by the actuator by one or more electric, hydraulic, pneumatic, and mechanical systems either by surface intervention or by intelligent systems in a downhole environment or uphole. In an exemplary embodiment described herein, the actuator and valve assembly 50 is actuated electrically using an encapsulated conductor from surface and a clamped on control module, such as an electronics module 60.

Figure 5:
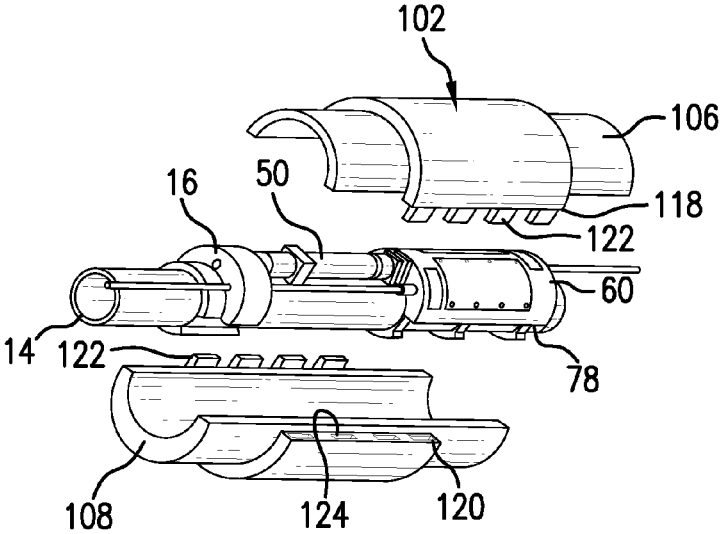
FIG. 5 depicts a partially exploded perspective view of the intelligent flow control assembly and clamshell packoff of FIG. 3.

The electronics module 60 may be provided with adjustable components for controlling and maximizing production, where the adjustments may be completed automatically or via operator intervention, or by a combination thereof. While the electronics module 60 includes electronics for controlling a controllable device, the module 60 may include any necessary elements other than electronics to control the controllable device. The electronics module 60 is clamped/attached exteriorly of the tubing 14, rather than integrated within a tubing 14, thus enabling the intelligent flow control device 10 to be usable with standard tubing 14 without the need for specialized tubing 14 having accommodations for electronics, conductors, connectors, etc. The line 32 may pass through the electronics module 60, with the electronics module 60 including an aperture for passing the line 32 therethrough. The electronics module 60 includes a housing 62 having a first end 64 and a second end 66. The housing 62 may include an inner surface 68 shaped to partially surround and hug the tubing 14 and an outer surface 70. The inner surface 68 of the housing 62 may have a radius of curvature, which substantially matches a radius of curvature of an exterior surface of the tubing 14. The outer surface 70 may also be curved so as to fit within the annulus between the tubing string 12 and the borehole. The second end 66 of the housing 62 includes a wall 72 formed between the inner surface 68 and the outer surface 70 of the housing 62. The actuator and valve assembly 50 may be connected to the wall 72 at the second end 66 of the housing 62, such that the actuator and valve assembly 50 are connected between the wall 72 at the second end 66 of the housing 62 and a wall at the first end 18 of the tubing coupling 16. The housing 62 may include panels 74 on the outer surface 70 for accessing electronic components or other components within the electronics module 60. The housing 62 of the electronics module 60 may further include a first side 76 and a second side 78 (FIG. 5). The housing 62 from the first side 76 to the second side 78 partially encircles the tubing 14 to which it is to be connected, such that the housing 62 is easily attached to the tubing 14 after the string 12 is assembled.

While it would be within the scope of these embodiments to connect the electronics module 60 to the tubing 14 in a variety of manners, in one exemplary embodiment, the electronics module 60 is clamped onto the tubing 14. At least one clamp 80 may be provided that attaches the first side 76 of the housing 62 to the second side 78 of the housing 62, thereby clamping the housing 62 to the tubing 14. The clamp 80 includes a curved inner surface sized to partially accommodate the tubing 14 therein when attached to the first and second sides 76, 78 of the housing. The clamp 80 includes a first end 82 attachable to the first side 76 of the housing 62 and a second end 84 attachable to the second side 78 of the housing 62. In an exemplary embodiment, the first end 82 of the clamp 80 may be permanently and/or pivotally attached to the housing 62, while the second end 84 is removable from the housing 62. In an alternative exemplary embodiment, both ends 82, 84 of the clamp 80 may be secured to the housing 62 after the housing 62 is aligned on a desired section of the tubing 14. The clamp 80 may be one large clamp attached to the housing 62, or multiple clamps 80 attached to the housing 62, where the number and size of the clamps 80 depends on the size of the housing 62 of the electronics module 60. The clamps 80 may include grooves 86 on an exterior surface thereof for receiving the aperture blocks 38, in which case the longitudinally extending channels 34, 36 in the tubing coupling 16 and the grooves 86 on the clamps 80 are aligned for receiving and supporting the aperture blocks 38 therethrough.

The clamped on electronics module 60 and actuator and valve assembly 50 provide intelligent flow control to the string 12, thus providing an intelligent completion string using a standard string 12. The intelligent completion string may include one or more intelligent control devices and one or more sensors for temperature, pressure, flow rate, chemical composition, etc. to enhance controllability of flow control into or out of the string 12. The intelligent completion string provided with one or more relevant sensors may query incoming fluid for composition and if not acceptable may execute a program in a downhole processor, which may be stored in the electronics module 60, to determine an appropriate action and then take action, such as closing the fluid entry port 28 using the actuator and valve assembly 50. The electronics module 60 may include a communication capability for communication with a remote location including but not limited to a surface location. It will be understood that both communication and control may be carried out by wire conductor, optic fiber conductor, acoustically, hydraulic line, or wirelessly, wherein any of the associated components may be included in the housing 62 of the electronics module 60 and the encapsulated conductor may include any of the necessary wire, lines, or fibers.

Due to the elements of the intelligent flow control device 10 being easily assembled onto existing tubing 14 of a string 12, the intelligent flow control device 10 described herein provides for a low cost alternative to systems that are integrated within tubing. Also, due to the attachment system, the flow control device 10 may be made up on the rig floor while making up the tubing 14 to the tubing coupling 16. For functionalities other than flow control such as, but not limited to, sensing and the like, the electronics module 60 or other control module having the housing 62 and securement features such as clamps 80, may be secured to the string 12 or other downhole tool, providing the intelligent flow control device 10 with modular capabilities. The electronics module 60 functions as a control module, and is connectible to any number of controllable devices for use with a downhole tool, such as the string 12, where one of the controlled devices can include the actuator and valve assembly 50.

Figure 3:
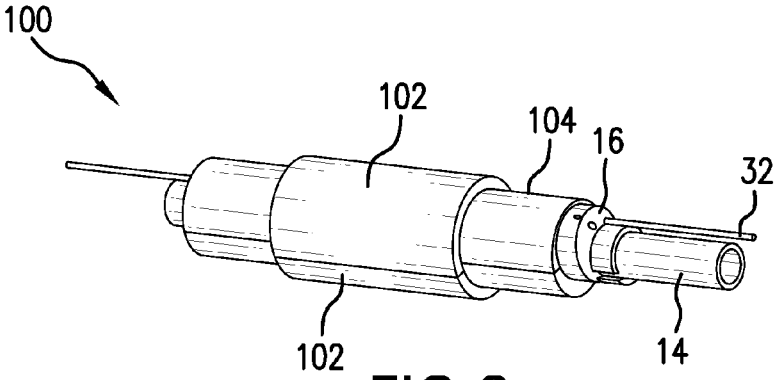
FIG. 3 depicts a perspective view of the intelligent flow control assembly of FIG. 1 including an exemplary embodiment of a clamshell packoff.
Figure 4:
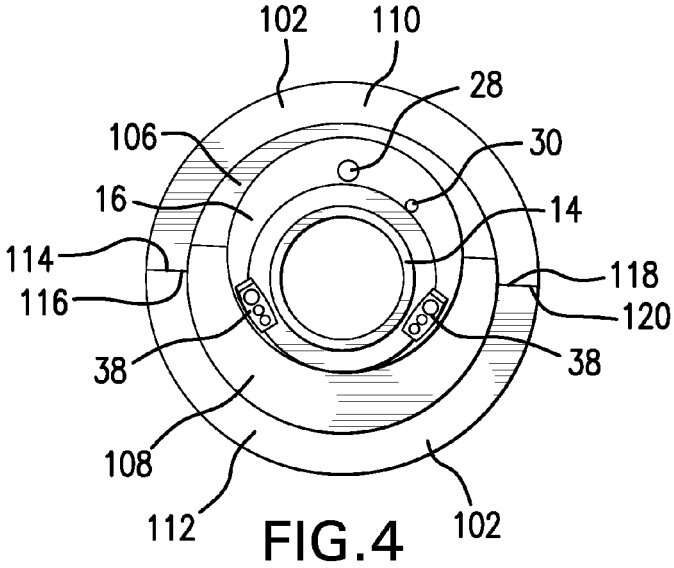
FIG. 4 depicts a front plan view of the intelligent flow control assembly and clamshell packoff of FIG. 3.

Turning now to FIGS. 3-5, in another exemplary embodiment, the intelligent flow control device 10 is surrounded by a packoff or packer to turn the device into a packer and flow control combination device. In addition to providing a sealing function, the packer protects the intelligent flow control device 10 from various shocks and impacts experienced within the borehole. It will be understood by one of ordinary skill in the art that devices for accomplishing the sealing function within the annulus are known in downhole arts as "packers" or "seals". While various mechanical, hydraulic, and/or inflatable packers are within the scope of these embodiments, in one exemplary embodiment of the packer, the packer is installable on the tubing 14 and intelligent flow control device 10 in a simple assembly process, such as by providing a clamshell packoff 100. The clamshell packoff 100 may include swellable or shape memory elements 102, such as water, oil or methane swellable rubber elements, for example or shape memory polymer elements, for example, clamped or otherwise secured on the intelligent flow control device 10. Water swellable elastomers and related compositions may be used to form water swellable seals on the system, for sealing the annular space between upper and lower portions of borehole depth. Packers that use elastomer swelling technology to provide a barrier in casing/open hole and casing/casing annuli may have a water reactive section, an oil reactive section, or both. A water reactive section may include water-absorbing particles incorporated in a field-proven nitrile-based polymer. These particles swell via absorbing water, which in turn expands the rubber without being physically absorbed into the rubber matrix, which can adversely affect properties. An oil reactive section may utilize oleophilic polymers that absorb hydrocarbons into the matrix. This process may be a physical uptake of the hydrocarbon which swell, lubricates and decreases the mechanical strength of the polymer chain as it expands. In an exemplary embodiment, the swellable element may include a composition as described in U.S. Patent Application No. 20090084550, which is herein incorporated by reference in its entirety.

In one exemplary embodiment, the clamshell packoff 100 is split into longitudinal sections, so that it can be easily equipped onto the intelligent flow control device 10 as needed. While two half sections are illustrated, additional longitudinal sections are also within the scope of these embodiments. The longitudinal split is inclusive of any split extending substantially from one longitudinal end to another longitudinal end. The packoff elements 102 may be provided on longitudinal sections 106, 108 of a mandrel 104 for supporting the packoff elements 102 onto the string 12. In one exemplary embodiment, a first mandrel 106 is sized to cover the housing 62 of the electronics module 60, the valve and actuator assembly 50, and a top half of the first section 22 of the tubing coupling 16, while a second mandrel 108 is sized to cover the clamps 80 and a bottom half of the tubing coupling 16. The mandrel 104 need not cover the transition section 26 of the tubing coupling 16 so that the fluid entry port 28 remains accessible to the annulus. Because the housing 62 and actuator and valve assembly 50 and top half of the first section 22 of the tubing coupling 16 are thicker than the clamps 80 and the bottom half of the tubing coupling 16, the first mandrel 106 may include thinner sections than the second mandrel 108. First and second edges of the first mandrel 106 are alignable with first and second edges of the second mandrel 108 to provide a substantially uninterrupted and uniform outer tubular surface of the mandrel 104. This outer tubular surface of the mandrel 104 provides a base surface for the packoff elements 102. While the mandrel 104 may have a length extending from the tubing coupling 16 to at least the first end 64 of the housing 62, the swellable elements 102 need not extend the same length as the mandrel 104. In an embodiment including two longitudinal sections of packoff elements 102, a first element 110 is disposed on the first mandrel 106 and a second element 112 is disposed on the second mandrel 108. Because the first and second mandrels 106, 108 are differently sized to accommodate the intelligent flow control device 10, the first and second swellable elements 110, 112 have a substantially uniform thickness, although varying thicknesses are within the scope of these embodiments. For connecting the first element 110 and first mandrel 106 to the second element 112 and second mandrel 108, a first edge 114 of the first element 110 may include engagement features that engage with engagement features of a first edge 116 of the second element 112, and a second edge 118 of the first element 110 may engage with engagement features of a second edge 120 of the second element 112. In one exemplary embodiment, the engagement features may include tongues 122 on one edge and correspondingly sized apertures 124 on an engaging edge, or alternatively tongue and grooves, intermeshing teeth, snap features, clamps, other clamshell style locking features, and other retainment elements. The longitudinal sections of the packoff elements 102 are inclusive of any sections extending substantially from one longitudinal end to another longitudinal end including, but not limited to, straight, curved, helical, and jagged splits.

Figure 6:
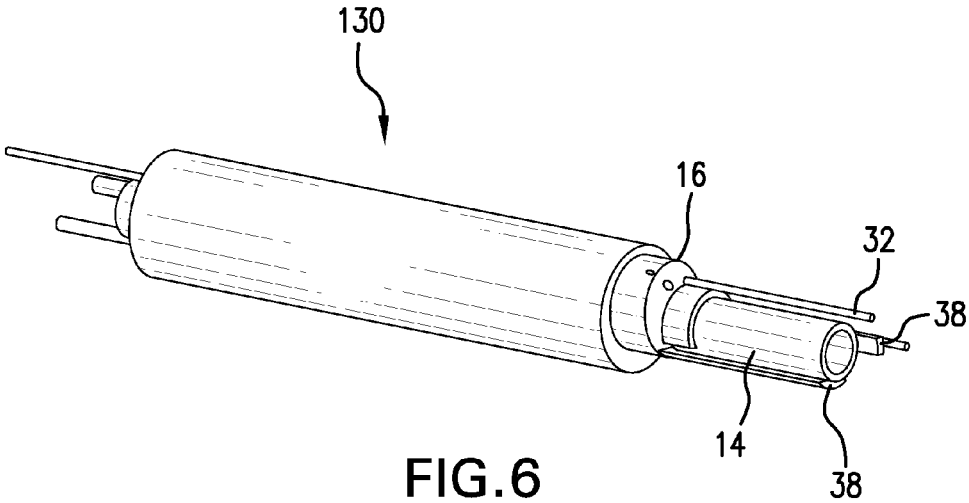
FIG. 6 depicts a perspective view of the intelligent flow control assembly of FIG. 1 including another exemplary embodiment of a clamshell packoff.
Figure 7:
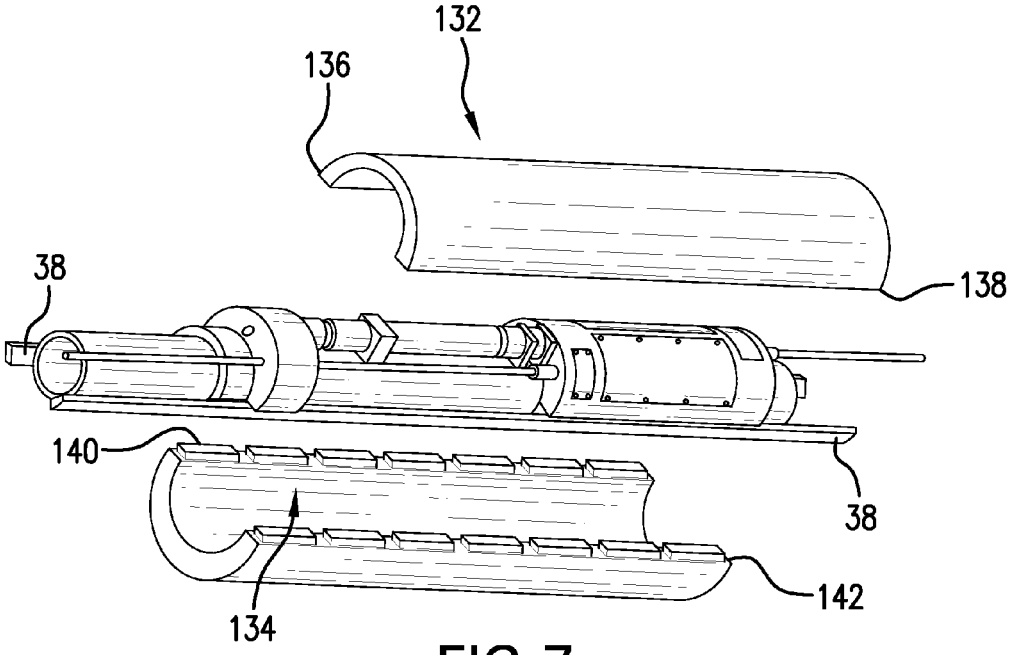
FIG. 7 depicts a partially exploded perspective view of the intelligent flow control assembly including the clamshell packoff of FIG. 6.
Figure 8A:
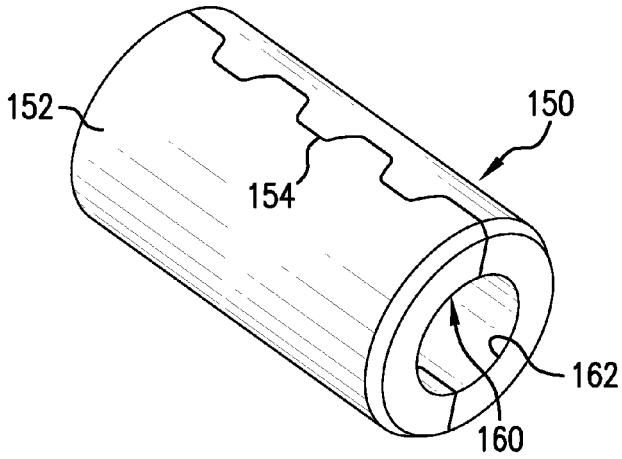
FIG. 8A depicts a perspective view of an exemplary embodiment of a clamshell packoff.
Figure 8B:
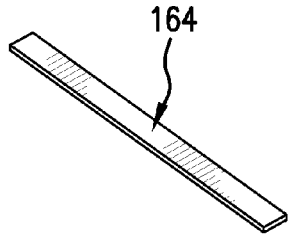
FIG. 8B depicts a perspective view of an exemplary embodiment of a metal bar insertable in the clamshell packoff of FIG. 8A.
Figure 9A:
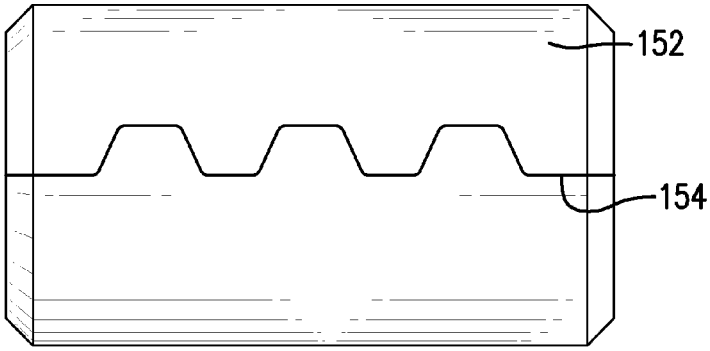
FIG. 9A depicts a side plan view of the clamshell packoff of FIG. 8A.
Figure 9B:
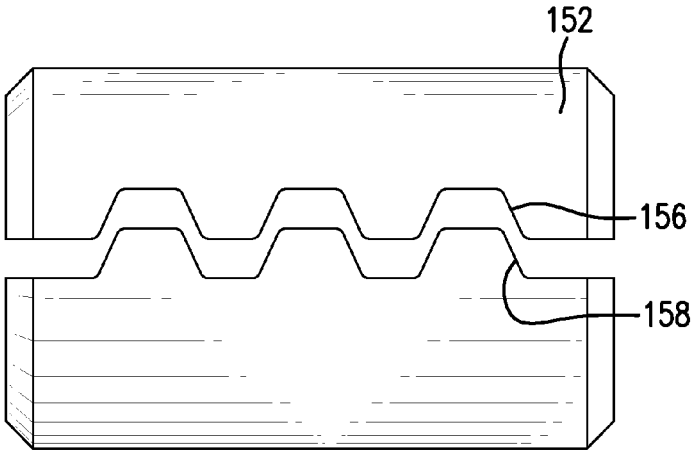
FIG. 9B depicts a side plan view of the clamshell packoff of FIG. 8A in a partially expanded configuration; and, FIGS. 10A-10E depict a side plan view of a two zone control and isolation system employing a swell hole packer.
Figure 10A:
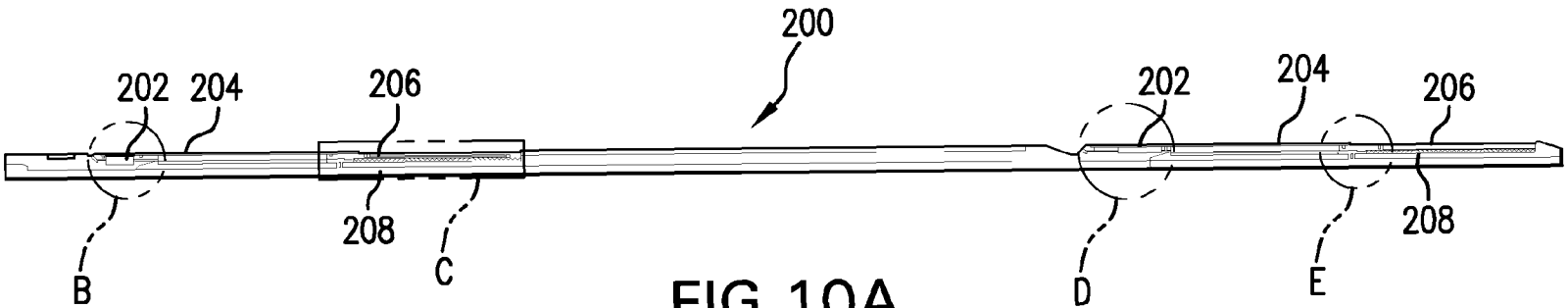
Figure 10B:
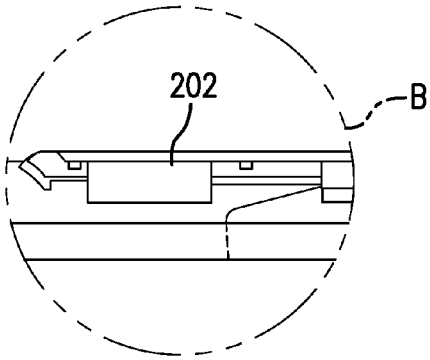
Figure 10C:
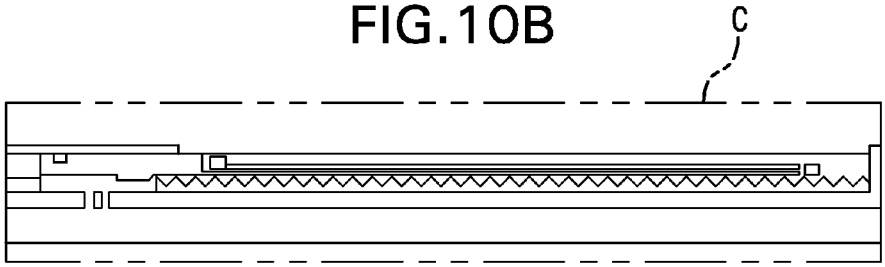
Figure 10D:
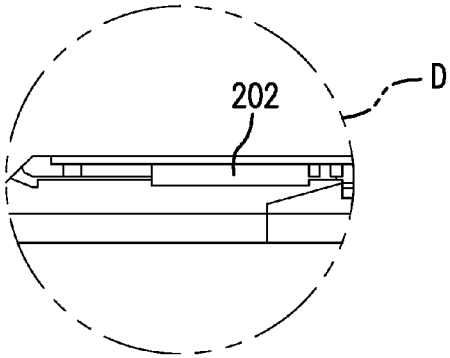
Figure 10E:
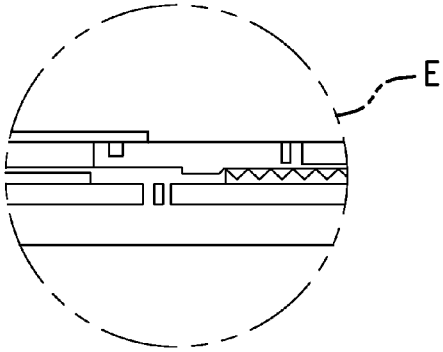

In another exemplary embodiment of the clamshell packoff 130, as shown in FIGS. 6 and 7, instead of employing the mandrel 104, first and second packoff elements 132, 134 may be provided to the string 12 that extend the length approximately from the tubing coupling 16 to the first end 64 of the housing 62 of the electronics module 60 to not only provide a sealing function but to also protect the intelligent flow control device 10 therein, although various lengths are also within the scope of these embodiments. Also, because the first and second mandrels 106, 108 are not provided to accommodate the different thicknesses of the housing side of the flow control device 10 versus the clamps side of the flow control device 10, the first packoff element 132 may include thinner sections than the second packoff element 134. First and second edges 136, 138 of the first element 132 are alignable with first and second edges 140, 142 of the second element 134 to provide a substantially uninterrupted and uniform outer tubular surface to the clamshell packoff 130. As in the previous embodiment, the first edge 136 of the first element 132 may engage with engagement features of a first edge 140 of the second element 134, and a second edge 138 of the first element 132 may engage with engagement features of a second edge 142 of the second element 134 to secure the clamshell packoff 130 to the string 12, encasing the intelligent flow control device 10 therein. In yet another exemplary embodiment, and adding to the modular capabilities of the present invention, the clamshell packoff described herein may also be used to surround the control module, such as the electronics module 60, and secured to a downhole tool, where the downhole tool may be a tubing string 12 or other tool, where the control module need not be connected to actuator and valve assembly 50.

An exemplary embodiment of a clamshell packoff 150 is shown in FIGS. 8A, 8B, 9A, and 9B, where meshing teeth engagement features are provided along edges of a swell or shape memory element 152. The element 152 is a tubular member split substantially from one longitudinal end to another longitudinal end. In one exemplary embodiment, because the element 152 including a reactive element rubber or shape memory polymer may be imparted with some flexibility, instead of providing two or more longitudinal sections of elements, only one element 152 is provided with a grooved cut 154 separating a first longitudinally extending edge 156 from a second longitudinally extending edge 158. The element 152 is installable on the string 12 or any other downhole tool by separating the first edge 156 from the second edge 158, surrounding the tool therein, and releasing the element 152 so that the first edge 156 mates with the second edge 158 once the tool is surrounded therein. While a particular arrangement of engagement features are shown on the edges 156, 158, it would also be within the scope of these embodiments to include alternate engagement features such as, but not limited to, tongues and apertures, differently sized and shaped meshed teeth, etc. A hole 160 adjacent an inner surface 162 of the element 152, such as near one of the first or second edge 156, 158, may be provided in the element 152 to accommodate flat metal bar 164 shown in FIG. 8B.

While packoffs have been described in combination with the valve assembly 50, control module 60, and tubing string 12, it should be understood that the packoffs described herein could also be used in combination with the control module 60 and a different controllable device, other than valve assembly 50, on a downhole tool other than the tubing string 12.

In another exemplary embodiment, a second flow control device, such as one including a second actuator and valve assembly and a second tubing coupling, is connected to the first end 64 of the electronics module 60, so that the first flow control device 50, 16 is actuated by the same module 60 as the second flow control device. When there is a flow control device on either side of the electronics module 60, then the clamshell style packoff arrangement will create isolation of two zones with a flow control device in each zone. With reference to FIGS. 10A-10E, an exemplary embodiment of two zone control and isolation is shown employing a swell or shape memory packer 200. Driver electronics 202, a magnetic sleeve, a screen 206, and an equalizer 208 may be provided on either side of the packer 200. It will be understood that multiple flow control devices and packoffs may be further provided for the creation of more than two zones.

Thus, the modular control system described herein includes any combination of a control module, a controllable device, and a packoff for use with a downhole tool, and the exact components of the system can be determined by the actual downhole tool and its intended use. The modular control system provides advantages over prior art downhole tools that are already outfitted to meet a particular intended use as the modular control system is suitable for use with a variety of standard downhole tools without expensive modifications thereto.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed:

1. A modular control system comprising:

a control module removably attachable to an exterior of a downhole tool;

a controlled device, the controlled device providing a function for the downhole tool, the controlled device controlled by the control module; and, supporting structure to support the controlled device on the exterior of the downhole tool and adjacent to the control module, wherein the controlled device is removably attachable to the exterior of the downhole tool.

2. The modular control system of claim 1, further comprising at least one clamp attached to the control module, wherein the at least one clamp is configured to secure the control module to the downhole tool.

3. The modular control system of claim 2, wherein the control module includes a housing, and the at least one clamp includes a curved clip sized to partially encircle the downhole tool, one end of the curved clip connected to a first side of the housing and a second end of the curved clip connectable to a second side of the housing.

4. The modular control system of claim 3, wherein the housing includes a curved interior surface to substantially lay flush with a curved exterior surface of the downhole tool.

5. The modular control system of claim 1, wherein the control module includes electronics.

6. The modular control system of claim 1, wherein the downhole tool is a tubing string, and the controlled device is a valve assembly which controls a flow port between an exterior of the tubing string and an interior of the tubing string, the valve assembly connected to and controlled by the control module.

7. The modular control system of claim 1, further comprising a clamshell packoff having a tubular member split along its wall substantially from one longitudinal end to another longitudinal end and having a longitudinally extending aperture sized to accommodate at least a portion of the control module, controlled device, and downhole tool therein.

8. The modular control system of claim 7 wherein the packoff further includes a mandrel longitudinally split into at least two sections attachable to the control module and controlled device, the mandrel also sized to encase the downhole tool therein, the tubular member having an expandable composition and encasing the mandrel therein.

9. The modular control system of claim 7, wherein the tubular member includes only one longitudinal split and is flexible to attach the tubular member to the control module, controlled device, and downhole tool.

10. The modular control system of claim 7, wherein the tubular member is longitudinally spit into at least two sections attachable to the control module, controlled device, and downhole tool.

11. The modular control system of claim 7, wherein the tubular member includes edges having engagement devices including at least one of intermeshing teeth and interfitting tongue and apertures.

12. A modular control system comprising:

a control module removably attachable to an exterior of a downhole tool, the downhole tool being a tubing string;

a controlled device providing a function for the downhole tool, the controlled device being a valve assembly which controls a flow port between the exterior of the tubing string and an interior of the tubing string, the valve assembly connected to and controlled by the control module; and, a tubing coupling having the flow port, the tubing coupling connectable along the string, the valve assembly connected to the flow port.

13. The modular control system of claim 12, wherein the valve assembly includes an actuator, and the actuator and valve assembly are connected between the tubing coupling and the control module at the exterior of the tubing string.

14. A modular control system comprising:

a control module removably attachable to an exterior of a downhole tool, the downhole tool including a tubing string;

a controlled device providing a function for the downhole tool, the controlled device including a first valve assembly which controls a flow port between the exterior of the tubing string and an interior of the tubing string and the controlled device further including a second valve assembly connected to and controlled by the control module, the control module positioned between the first and the second valve assemblies.

15. The modular control system of claim 14, further comprising a clamshell packoff including a tubular member encasing the control module and the first and second valve assemblies isolating two zones with a flow control device in each zone.

16. A modular control system comprising:

a control module removably attachable to an exterior of a downhole tool;

a controlled device providing a function for the downhole tool the controlled device controlled by the control module; and, a clamshell packoff having a tubular member split along its wall substantially from one longitudinal end to another longitudinal end and having a longitudinally extending aperture sized to accommodate at least a portion of the control module, controlled device, and downhole tool therein, wherein the tubular member is an expandable packer.

17. The modular control system of claim 16, wherein the expandable packer includes a swell element composition having a water, oil, or methane reactive element composition.

18. A modular control system comprising:

a control module removably attachable to an exterior of a downhole tool; and, a clamshell packoff including a tubular member split along its wall substantially from one longitudinal end to another longitudinal end and having a longitudinally extending aperture sized to accommodate the control module and downhole tool, wherein the tubular member is an expandable packer.

19. The modular control system of claim 18, wherein the control module controls a controlled device removably attachable to the exterior of the downhole tool.

20. The modular control system of claim 18, wherein the expandable packer includes a swell element composition.

* * * * *